US005140920A

United States Patent [19]

Bellio et al.

[11] Patent Number: 5,140,920

[45] Date of Patent: Aug. 25, 1992

[54] APPARATUS FOR DETECTING SKIPPED STITCHES

[75] Inventors: Stephen L. Bellio, West Roxbury; Richard K. Arauo, Tewskbury, both of Mass.

[73] Assignee: The Charles Stark Draper Laboratory, Inc., Cambridge, Mass.

[21] Appl. No.: 577,852

[22] Filed: Sep. 7, 1990

[51] Int. Cl.[5] ..... D05B 69/36

[52] U.S. Cl. ..... 112/278

[58] Field of Search ..... 112/273, 278; 250/561, 250/559; 66/163; 200/61.13, 61.18

[56] References Cited

U.S. PATENT DOCUMENTS

| | | | |
|---|---|---|---|
| 3,687,095 | 8/1972 | Jackson | 112/273 X |
| 3,738,296 | 6/1973 | MacKenzie et al. | 112/273 |
| 3,785,308 | 1/1974 | Brandriff et al. . | |
| 3,843,883 | 10/1974 | DeVita et al. | 250/233 |
| 4,102,283 | 7/1978 | Rockerath et al. | 112/131 |
| 4,170,951 | 10/1979 | Dobrjanskyj | 112/278 |
| 4,186,672 | 2/1980 | Burton | 112/273 |
| 4,192,243 | 3/1980 | Blessing et al. | 112/273 |
| 4,196,685 | 4/1980 | Tamura | 112/273 |
| 4,426,948 | 1/1984 | Olasz et al. | 112/273 |
| 4,432,297 | 2/1984 | Kemmel | 112/278 |
| 4,558,654 | 12/1985 | Schilling et al. | 112/298 |
| 4,602,582 | 7/1986 | Rawson | 112/278 |
| 4,693,196 | 9/1987 | Hager | 112/273 |
| 4,732,098 | 3/1988 | Mertel et al. | 112/278 |
| 4,754,722 | 7/1988 | Rohr | 112/278 |
| 4,793,273 | 12/1988 | Hara et al. | 112/278 X |
| 4,805,544 | 2/1989 | Dobner et al. | 112/278 |
| 4,841,890 | 6/1989 | Tancs | 112/273 |
| 4,934,292 | 6/1990 | Mardix et al. | 112/273 |
| 4,938,159 | 7/1990 | Shibata | 112/273 |

FOREIGN PATENT DOCUMENTS

| | | |
|---|---|---|
| 3625630 | 7/1986 | Fed. Rep. of Germany . |
| 3625963 | 7/1986 | Fed. Rep. of Germany . |
| 60-52629 | 3/1985 | Japan . |
| 60-94943 | 5/1985 | Japan . |
| 2008631 | 10/1978 | United Kingdom . |

OTHER PUBLICATIONS

Datalogic, Inc., "SR20 Series: Thread Breakage Detector", LITPE 024, 75.

Pfaff, GmbH, "The G-Type Hook and Bobbin Thread Monitor 926/01", Information For the Sewing Industry, Mar. 1989.

*Primary Examiner*—Peter Nerbun

*Attorney, Agent, or Firm*—Lahive & Cockfield

[57] ABSTRACT

Apparatus for detecting skipped stitches for sewing machines having a bobbin-type assembly using a thread movement sensor for continuous monitoring of the presence of a needle thread in a beam path. Needle thread movement is correlated with needle shaft rotation per stitch cycle to detect instances when there is no thread movement during a stitch cycle. The apparatus may also include a bobbin thread monitor system to detect residual bobbin thread.

16 Claims, 4 Drawing Sheets

APPARATUS FOR DETECTING SKIPPED STITCHES

BACKGROUND OF THE DISCLOSURE

This invention relates to an apparatus for monitoring the stitching quality of sewing machines and, in particular, to detecting skipped stitches for sewing machines.

With the clothing industry becoming increasingly automated, there is a need for systems that monitor and regulate the functions and output of high speed sewing equipment. Certain of these systems are utilized to monitor the stitching of sewing machines to detect skipped stitches in apparel manufactured by automated sewing machines.

In the general, improper stitches may from time to time be introduced in a workpiece manufactured with the use of an automated sewing machine. Generally, improper stitches may have the form of malformed stitches or skipped stitches. There are many causes of skipped stitches. Skipped stitches can develop from improper synchronization and/or alignment between two active elements of the sewing machine, e.g., the needle and the bobbin hook. Normally, the bobbin hook catches the needle loop and brings the needle thread around the bobbin to form a lockstitch. Skipped stitches are most often formed when the bobbin hook fails to grasp the needle loop, but may also be the result of broken needle thread.

Malformed stitches are formed when the stitch is not properly set. A stitch is properly set when the needle thread and the bobbin thread interlock in the center of the workpiece. A malformed stitch occurs when the stitch interlocks at either the top of the workpiece or the bottom of the workpiece.

In the prior art, skipped stitch detection systems are based upon monitoring the tension of the needle thread. As an example of this system, in U.S. Pat. No. 4,102,283 (Rockerarth et al.) the loss of thread tension generally is said to correspond to a skipped stitch, and this reduction in normal thread tension triggers a sensing device. The sensitivity of these systems ranges from complete loss of thread tension, for example due to the thread breaking, to sensing a momentary reduction in normal thread tension.

Other systems are based upon monitoring thread consumption, and may correlate thread consumption with total number of stitches, to detect a skipped stitch. As an example of this system, in U.S. Pat. No. 3,843,883 (DeVita et al., Oct. 22, 1974) a monitor is used to measure thread consumption which is then compared to a predetermined standard of thread use, deviation from which activates an output signal.

A system used for detecting skipped stitches in a lockstitch type 301 sewing machine is disclosed in UK Patent Application No. GB 2008631. That system involves monitoring the length of a seam as compared with the upper thread consumption required to produce the seam. Actual thread consumption is then compared against a predetermined consumption value, any difference of which corresponds to an improperly formed seam. However, the difference in upper thread consumption between correct stitches and skipped stitches is not always substantial enough to be reliable in fast-rate sewing machines. This is best demonstrated when two pieces of thin fabric are being sewn together. Generally, measurements of the difference in thread consumption per stitch includes the thickness of two plies of fabric (assuming the stitch is set at center). For example, letting stitch length (SL)=0.125 inches, and ply thickness (PT)=0.01 inches, then the percentage decrease for a skipped stitch would be: 100 * [(2 * PT)/SL]=100 * [(2*0.010)/0.125]=16%. If thread tensions are not adjusted properly, this percent decrease could go to zero. Thus, there is a need for a direct, effective method of detecting skipped stitches in a fast-speed lockstitch type 301 sewing machine.

A primary shortcoming of the prior art is the unreliability of these systems at high sewing speeds, for example greater than 5,500 stitches per minute. DeVita states that the apparatus disclosed therein makes "mechanically possible the very high running speeds of about 2,000 stitches per minute desirable for such [lockstitch] sewing machines" (emphasis added). These systems fail to detect a momentary reduction of thread tension when the sewing machine is operating at high sewing speeds. The reduction in tension for an improper stitch at high sewing speeds tends to be less and in a range that the prior art fails to detect. As a result, these systems tend to be less reliable and thus fail to perform these functions with great accuracy.

There exists a need for better methods and systems for detecting skipped stitches that are reliable at high sewing speeds. To accommodate the advances in the clothing automation, particularly the increase in sewing speeds, it is an object of the invention to provide a simple, reliable system for detecting skipped stitches that would satisfy a substantial need in the art.

SUMMARY OF THE INVENTION

Briefly, the invention is an apparatus for detecting improper stitch formation for a sewing machine of the type having an axially reciprocal needle, a drive motor with an output shaft for driving the needle through at least one reciprocal motion per stitch, and a bobbin assembly. The apparatus of the invention includes three components: a sensor for detecting thread movement along the longitudinal axis of the needle thread; a sensor for detecting drive shaft rotation; and a system for determining if a proper stitch is formed, based on the input from the two sensors.

The apparatus may also include a bobbin thread consumption system for notifying the user when the amount of residual bobbin thread in the bobbin assembly falls below a predetermined threshold level.

BRIEF DESCRIPTION OF THE DRAWINGS

The foregoing and other objects of this invention, the various features thereof, as well as the invention itself, may be more fully understood from the following description, when read together with the accompanying drawings in which.

Like elements in each Figure have the same number.

DESCRIPTION OF THE PREFERRED EMBODIMENT

Figure 1A:
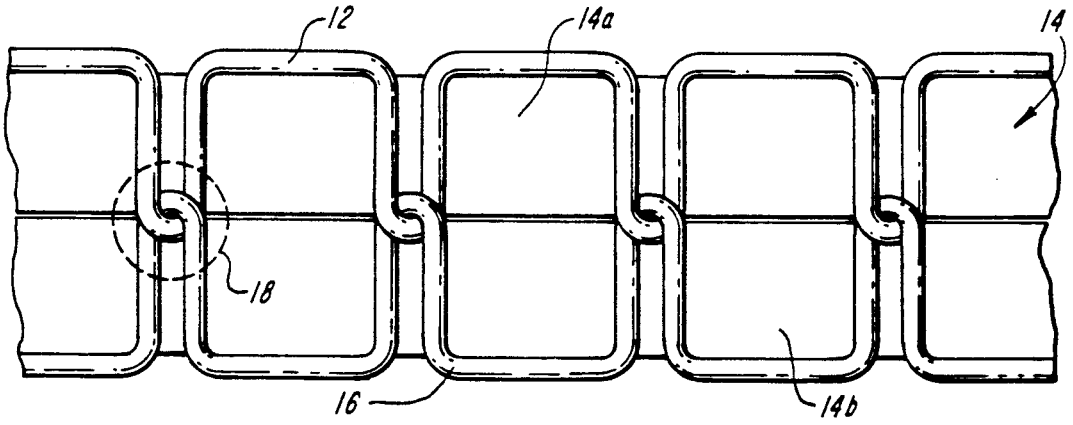
FIG. 1A shows in diagrammatic form an exemplary series of proper Class 300 lockstitches.

A diagrammatic representation of Class 300 lockstitches is shown in FIG. 1A. As shown, a needle thread 12 generally runs along the top of an upper limp material segment 14*a*, and a bobbin thread 16 generally runs along the bottom of segment 14*b*. In the illustrated stitch configuration, the needle thread loops 18 are shown with exaggerated width for clarity.

Figure 1B:
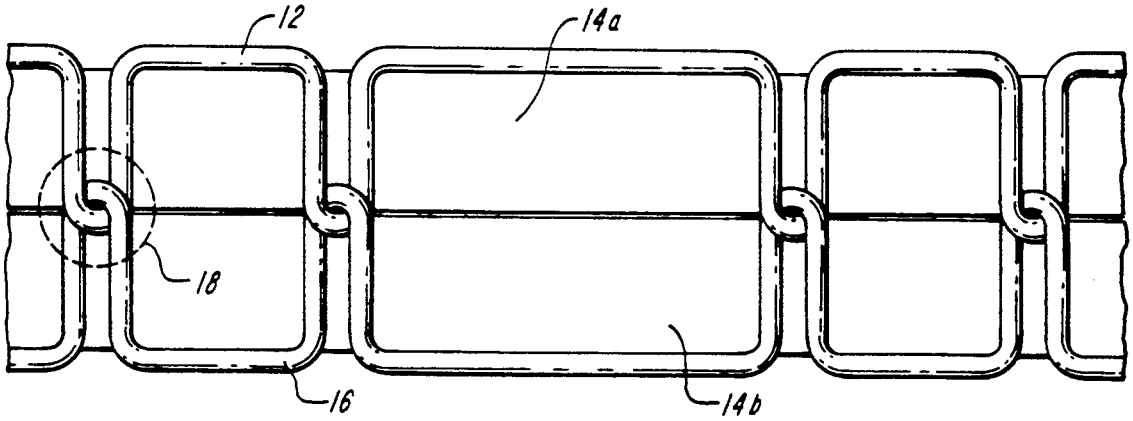
FIG. 1B shows in diagrammatic form an exemplary skipped Class 300 lockstitch.

Both the needle thread 12 and the bobbin thread 16 periodically pass partially through one or both segments 14*a* and 14*b*, interlock to form the stitches, and then return to the respective top and bottom surfaces of segments 14*a* and 14*b*. The interlocking portions of the threads are referred to herein as loops. When the lockstitch is "correctly formed", the loops from the needle thread 12 and bobbin thread 16 interlock approximately mid-way between the top and bottom surfaces of segments 14*a* and 14*b*, as shown in FIG. 1A. An exemplary skipped stitch is shown in FIG. 1B. In practice, the interlock point location may range all the way from either the top surface of segment 14*a* to the bottom surface of segment 14*b*.

Figure 2B:
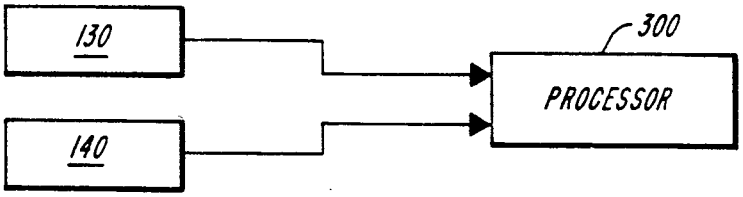
FIG. 2B shows the relationship between a processor, a shaft monitor, and a thread movement sensor.
Figure 2A:
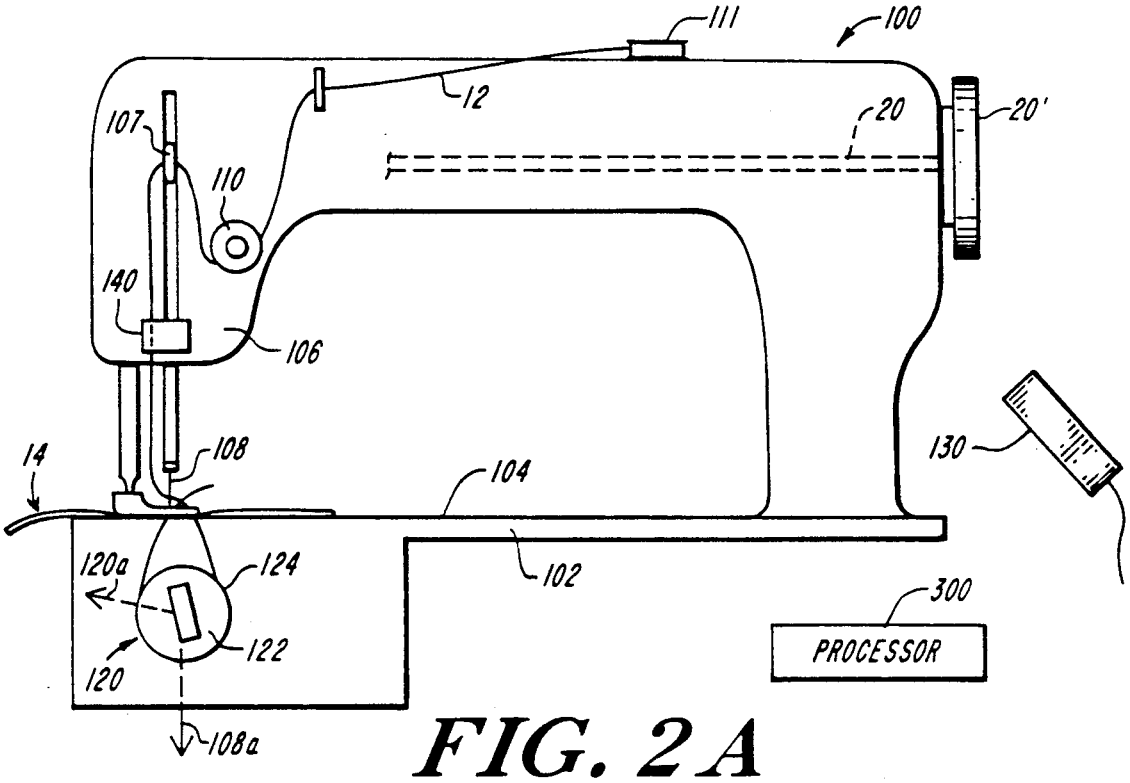
FIG. 2A shows a side elevation view of a sewing machine including a thread movement sensor apparatus of the Present invention.

Referring now to FIG. 2 generally, in the formation of normal or correct lockstitches, the bobbin hook 124 of sewing machine 100 catches a needle loop and brings the needle thread 12 around the bobbin case 122.

A proper or improper stitch can be detected preferably in a time window during a stitch cycle. Proper stitches are indicated by needle thread movement during the window. A skipped stitch is the result of the bobbin hook 124 failing to grasp the needle thread 12, resulting in the indicative lack of needle thread movement in the window. Based upon this characteristic of skipped stitches, the present invention provides an apparatus for monitoring, on a continuous basis, needle thread movement during a time window of the stitch formation on a sewing machine as correlated with the rotation of the main drive shaft of the machine, as an indicator of a skipped stitch.

FIG. 2 shows a side elevation cut-away view of a sewing machine 100 including a skipped stitch detection system embodying the present invention. The sewing machine 100 includes a base member 102 having a planar workpiece support surface 104, and a sewing head 106 with a reciprocating needle 108 extending along vertical needle axis 108*a*. The needle 108 receives needle thread 12 from a needle thread source 111 by way of a tension assembly 110.

An important aspect of the invention, and as shown in FIG. 2, the thread movement sensor 140 of the invention is positioned, or mounted, on the sewing head 106 between the take-up lever 107 and the needle 108. In this location, the needle thread 12 passes through the thread movement sensor 140 to detect thread movement during stitch formation.

Beneath the support surface 104, a bobbin assembly 120 includes a bobbin case 122 which rotates about axis 120*a*. The bobbin assembly 120 further includes a bobbin hook 124 extending from the bobbin case 122 for catching the needle thread loop as it is formed beneath the surface 104. Also shown in FIG. 2 is a shaft monitor assembly 130 for detecting the rotation of the shaft 20 during the formation of a lockstitch. The monitor assembly 130 may be any type of sensor assembly for detection of movement of the shaft 20.

In the preferred form of the shaft monitor assembly, a commercial sensor available from Sick Optic-Electronik, Inc., 2059 White Bear Avenue, St. Paul, MN, is used. Other commerically available sensors may be used. Generally, the sensor includes a detector which provides a shaft output signal characterized by a pulse corresponding to the times light reflects back from a target positioned on the shaft 20 as the shaft rotates during each stitch cycle.

Figure 4:
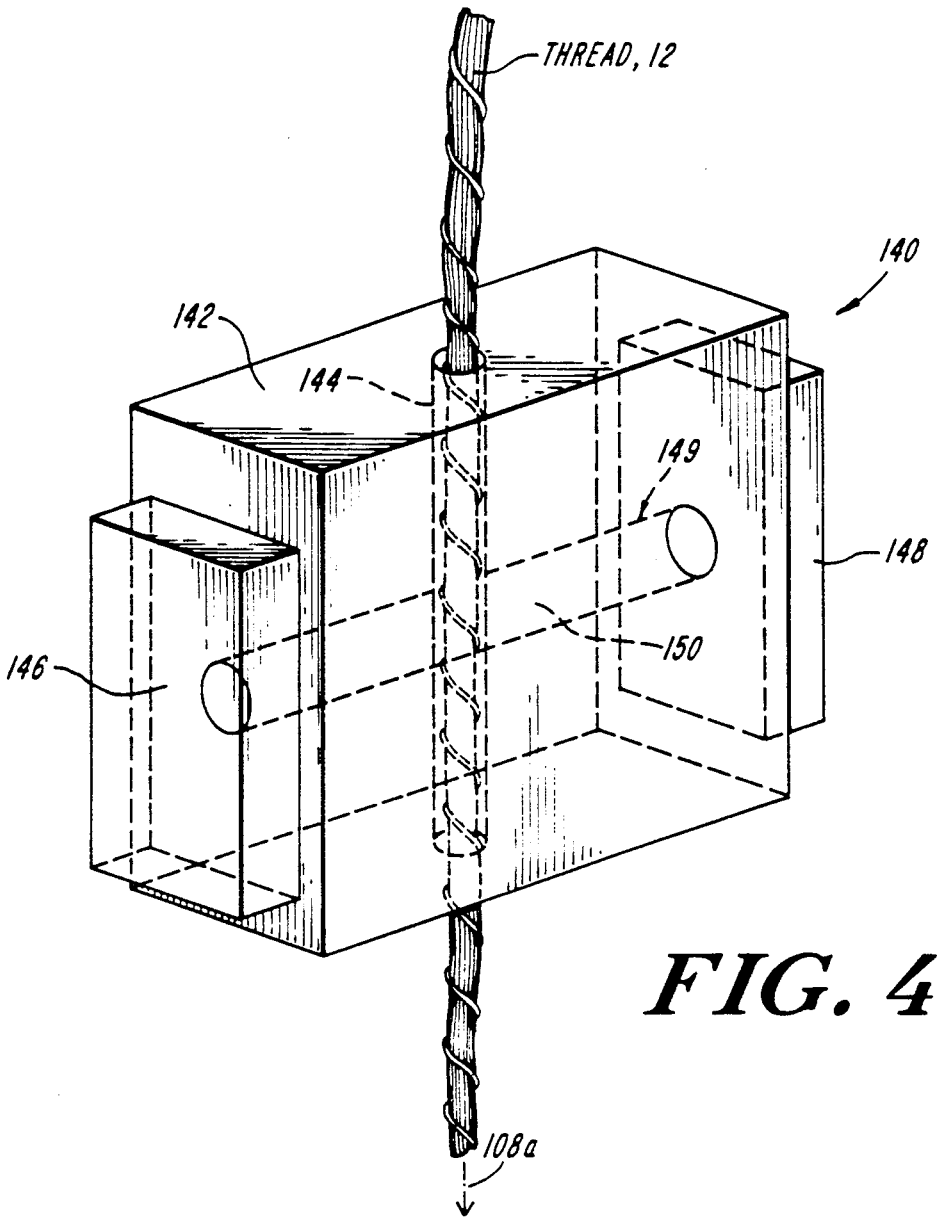
FIG. 4 shows a perspective view of the thread movement sensor apparatus of the present invention.

The sewing machine of the illustrated embodiment includes a thread movement sensor 140 mounted on the sewing head 106. FIG. 4 shows a perspective view of one embodiment of the sensor 140 of the present invention. In the illustrated embodiment, the thread movement sensor 140 includes a housing 142 for mounting the sensor on the sewing head 106. At one end of the housing is an emitter 146, which may include a light emitting diode (LED) for generating a light beam 150 which is directed through a channel 149 within housing 142. In the illustrated embodiment, the beam 150 cross-section substantially matches the channel 149 cross-section. At the other end of the housing, opposing the emitter 146, is located a detector 148, such as a phototransistor and associated circuitry (not shown). A thread channel 144 extends along needle axis 108A and intersects the channel 148. Needle thread 12 passes through channel 144 on its way to the needle. While the exact orientation of the beam 150 is not critical to the invention, it is essential that the needle thread 12 is constantly located substantially within the band of the beam 150. Thread movement is indicated by detected changes in reflection or absorption of the beam as the thread passes through the beam where such changes are due to variation in the thread characteristics (e.g., reflection or absorption) along its principal axis. In an alternate form of the invention, thread movement is detected by detected changes due to variations in surface texture of the thread along its principal axis.

Figure 3:
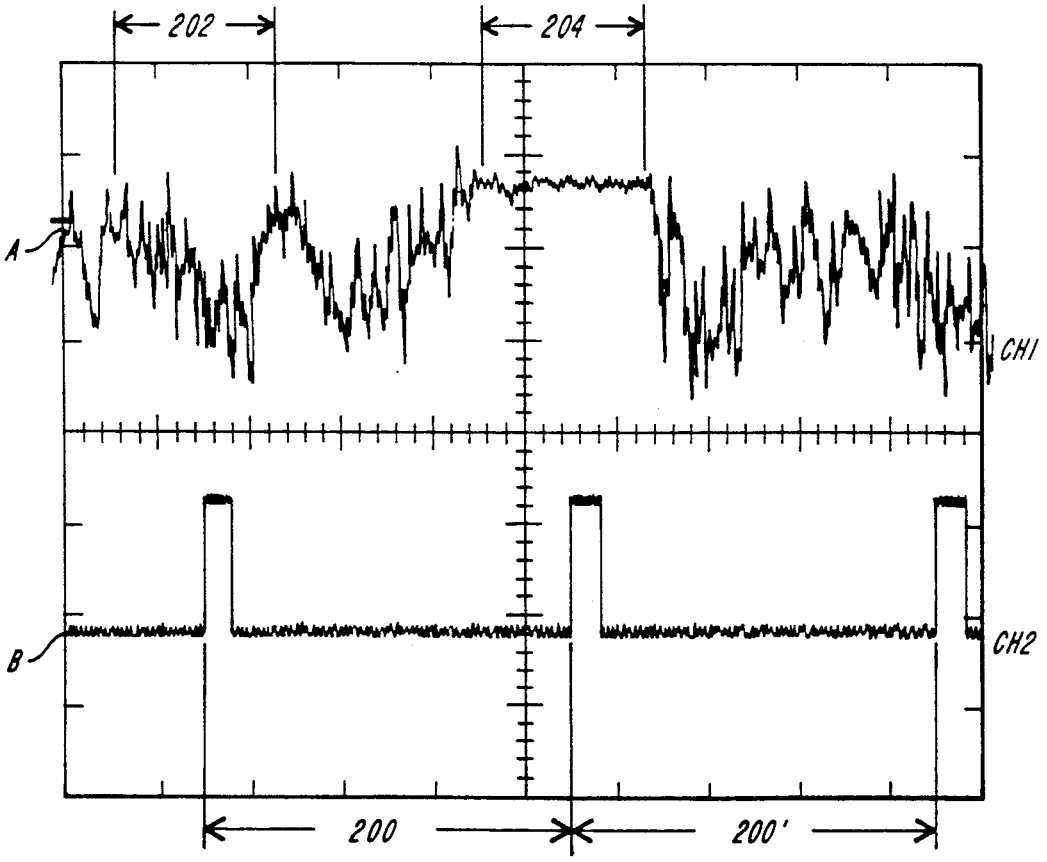
FIG. 3 shows an output signal generated by the sensor assembly of the thread movement sensor apparatus of the present invention.

FIG. 3 shows an output voltage signal generated by the sensor assembly 140 of the thread movement sensor apparatus of the present invention (Trace A) and shows an output voltage signal generated by sensor 130 (Trace B), on a common time axis. Variations in the voltage level in Trace A are indicative of needle thread movement, as measured by an embodiment of the present invention having an aperture diameter of 0.018 inch for channel 144. Trace B identifies successive stitch cycles 200 and 200', as indicated by shaft rotation, measured using the shaft sensor 130. Measurements were taken at sewing speeds of 3000 rpm, 8 stitches per inch, thus one stitch cycle 200 occurs in approximately 20 milliseconds.

Two time windows 202 and 204 are indicated in FIG. 3, with window 202 being associated with a predetermined portion of cycle 200, and window 204 being associated with the same portion of cycle 200'. During stitch cycle 200, as shown at line B of FIG. 3, the needle thread 12 constantly moves. By contrast, corresponding window 204 in cycle 200' indicates lack of needle thread movement. The specific portion of each stitch cycle corresponds to the point where the needle thread is being pulled around the bobbin. The bobbin hook is at the 12 o'clock position when it engages the needle thread loop. Regions 202 and 204 correspond to bobbin hook movement from the 11 o'clock position, counterclockwise to the 1 o'clock position.

During proper operation of the sewing machine of the illustrated embodiment of FIG. 2, the thread movement sensor 140 maintains a constant beam 150 through which the needle thread 12 moves during stitch formation. The shaft monitor 130 generates a stitch signal similar to that shown in FIG. 3. A signal processor 300 processes and correlates the information received from both the shaft monitor 130 and the thread movement sensor 140 to determine whether a stitch was formed during each stitch cycle.

Predetermined values are stored corresponding to thread movement during a predetermined portion of the stitch cycle. The stored values are compared with actual thread movement during this portion of the stitch cycle. A stitch signal is identified corresponding to instances wherein the stored values differ by a predetermined amount from the actual thread movement during a predetermined portion of the stitch cycle. The stitch signal is indicative of an improper stitch. If there is no movement of thread during a predetermined segment of a stitch cycle, a signal will be generated for notifying the sewing machine operator of a skipped stitch. The sewing machine operator may either be a human operator or a computer/machine operator depending upon the technology available at the time.

The thread movement sensor may be used without the correlation of the shaft monitor, to merely detect the movement of the thread for the purpose of thread break detection. However, during high-speed operation of sewing machines, such as occurs in large-scale production of apparel, it is important to have real-time detection of skipped stitches detected during each stitch cycle. Prompt, accurate detection of skipped stitches is important in such applications.

Figure 6:
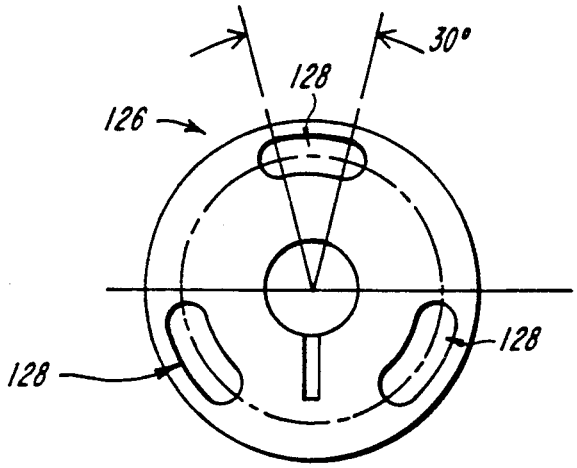
FIG. 6 shows a front elevation view of a bobbin spool as contemplated for use in the apparatus of the present invention.
Figure 5A:
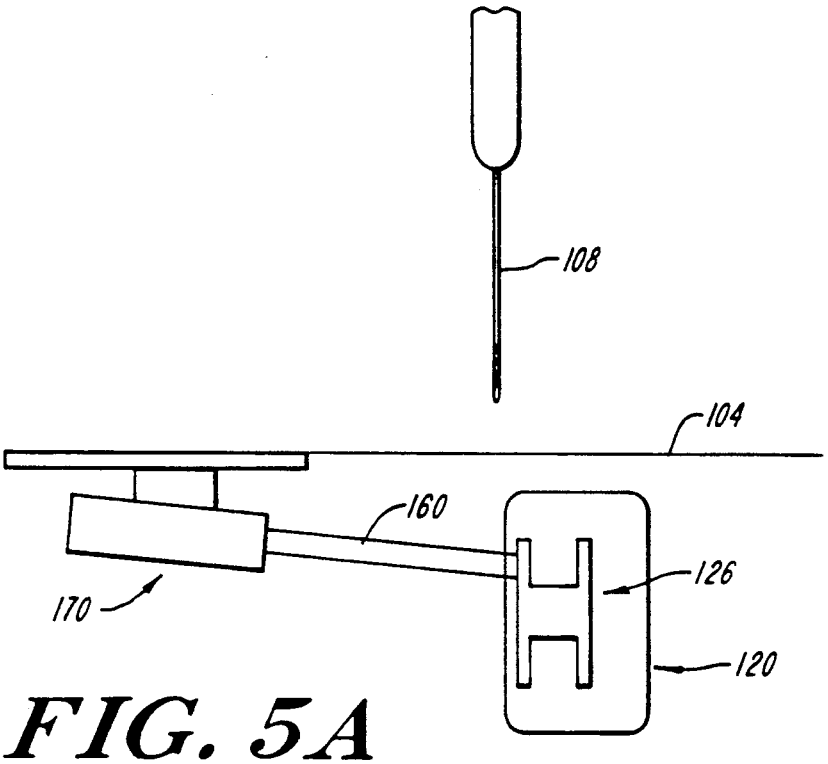
FIG. 5A shows a schematic representation of the bobbin thread monitor system of the present invention.
Figure 5B:
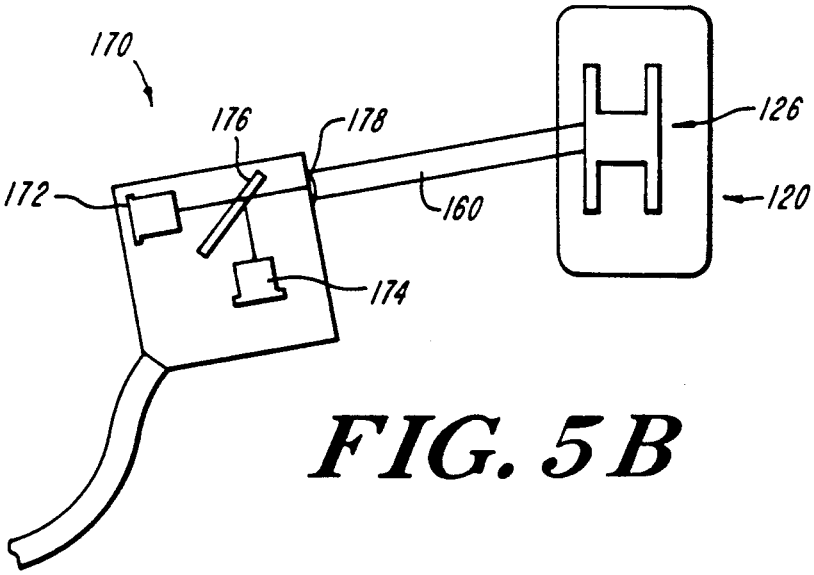
FIG. 5B shows a bottom plan view of the bobbin thread monitor system of FIG. 5A.

In an alternate form of the invention, the apparatus may include a bobbin thread detection system for detecting residual bobbin thread, such as that shown in FIGS. 5A and 5B. In the illustrated system, bobbin spool 126 rotation is detected using a coaxial optical sensor system 170. As best shown in FIG. 6, the bobbin spool 126 has retro-reflective surfaces 128 on the outer surface of one of its sidewalls. A light beam 160 is directed from an emitter 172 to the retro-reflective surfaces 128 and is returned back to a detector 174 along the same axis as the emitting beam 160. As the retro-reflective surfaces pass by the beam 160, the beam is reflected back to the detector 174 along its initial propagation axis. The resulting signal from detector 174 includes a succession of pulses whose repetition rate is proportional to the rotational rate of the spool. This coaxial source-sensor arrangement is particularly effective in the high vibration environment of a sewing machine due to the mechanical integrity of the composite source-sensor structure.

In addition, a counter (not shown) may be attached to the detector to monitor the number of bobbin rotations, as calculated from the number of times the retro-reflective surfaces 128 pass in front of the light beam. The number of rotations required to load the bobbin may be determined by an off-line winding station. This pre-load number may then be stored in a memory device. The number of bobbin rotations occurring during operation is then counted against the pre-load number to determine the level of residual thread on the bobbin. Alternatively, the counter may count down from the preload number towards zero, at which point a signal is generated by the counter to indicated bobbin thread depletion. In the preferred embodiment, the counter is a microprocessor.

An example of a sensor which may be used in the bobbin thread detection system is shown in FIGS. 5A and 5B. It includes a light emitting diode (LED) 172, beamsplitter 176, lens 178, and detector 174. Light from the emitter 172 passes through the beamsplitter 176 and the lens 178 to produce a spot of light on the retro-reflective surface 128, or other reflecting surface forming a target on the bobbin spool 126, at some distance from the lens 178. Light reflecting off this target 128 returns through the lens 178, then reflects off the beamsplitter 176 and onto the detector 174. This type of sensor is typically used with reflective surfaces, and may be purchased from Datalogic, 301 Gregson Drive, Cary, NC.

Using the coaxial optical system described above permits location of the sensor 170 at any angle up to 20 degrees from normal to the bobbin spool 126. Bobbin consumption, or residual bobbin supply is counted against the pre-load amount in a manner similar to that described above.

Alternatively, the apparatus of the present invention may include the bobbin thread monitor disclosed in U.S. Ser. No. 548,111. In yet another form of the invention, an optical sensor system, similar to that used as the output shaft monitor 130 described above in relation to FIG. 4, may be used place of the coaxial system described above.

While the invention is discussed above in relation to lockstitch-forming sewing machines, the invention may be used in monitoring the formation of other stitches, particularly those requiring the use of a bobbin. Improperly formed or skipped stitch types not requiring a bobbin, such as chainstitches, may also be detected using the invention disclosed above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for detecting an improper stitch for a lockstitch sewing machine, said machine including:

an axially reciprocal needle adapted to incorporate at least one needle thread into a succession of stitches, said needle being movable along a longitudinal needle axis;

a reciprocal take-up lever;

a drive motor having an output shaft and associated means for driving said needle through at least one reciprocal motion per stitch;

a rotatable bobbin assembly including means for incorporating a bobbin thread and said needle thread into said stitches during one stitch cycle, said needle thread being disposed in part along a needle thread axis extending between respective end sections of said needle and said take-up lever; the improvement comprising:

needle thread detection means for detecting needle thread movement along said needle thread axis between said take-up lever and said needle during a predetermined portion of said stitch cycle;

shaft rotation means for detecting each of said output shaft rotations;

signal means for identifying a stitch signal corresponding to said predetermined portion of said stitch cycle wherein substantially no needle thread movement is detected, said stitch signal being indicative of formation of an improper stitch.

2. Apparatus according to claim 1 wherein said needle thread detection means comprises:

A. a detector housing having a channel extending therethrough along a channel axis for receiving said needle thread between said take-up lever and said needle, whereby said longitudinal thread axis is substantially aligned with said channel axis;

B. beam generating means positioned on one side of said channel for generating an optical beam of predetermined width which intersects substantially the full width of said channel; and C. beam detection means positioned on the side of said channel opposite said beam generating means for detecting said optical beam; whereby movement of said needle thread through said optical beam is detected due to differences in thread characteristics along the length of said thread.

3. Apparatus according to claim 2 wherein said channel is of sufficient size to constrain movement of said needle thread within a predetermined region, said region being determined by boundaries of said beam.

4. Apparatus according to claim 3 further comprising means for storing predetermined values corresponding to thread movement per said predetermined portion of said stitch cycle.

5. Apparatus according to claim 4 further comprising means for comparing said stored values with actual thread movement per predetermined portion of said stitch cycle corresponding to said stitch signals.

6. Apparatus according to claim 3 further comprising means for generating an output signal corresponding to said stitch signal.

7. Apparatus according to claim 1 further comprising a residual bobbin thread detection system, including:

sensor means for identifying each rotation of said bobbin assembly;

bobbin storage means for storing values corresponding to a number of bobbin assembly rotations during a first bobbin loading period;

processor means for correlating said stored values from said first bobbin loading period with each of said bobbin assembly rotations during a second, operational period, and identifying times when said stored value from said first bobbin loading period equals said bobbin assembly rotations during said second, operational period; and signal generating means for generating a signal corresponding to said identified times.

8. Apparatus according to claim 7 wherein said sensor means includes a coaxial optical detector system.

9. Apparatus according to claim 8 wherein said collinear optical detector system comprises an optical sensor, said optical sensor including an emitter, a beam splitter, a lens, a detector, and a partially optically reflective bobbin assembly surface, said system underlying the locus of passage of said needle thread during proper stitch formation; and including means for directing light from said emitter through both said beamsplitter and said lens onto said reflective surface;

means for directing portions of said light reflected from said reflective surface through said beamsplitter and onto said detector; whereby a predetermined amount of said portions of said reflected light corresponds to one bobbin assembly rotation.

10. Apparatus according to claim 8 wherein said collinear optical detector system comprises an optical sensor, said optical sensor including an emitter, a beam splitter, a lens, a detector, and an optically reflective bobbin assembly surface, said system underlying the locus of passage of said needle thread during proper stitch formation; and including means for directing light from said emitter through both said beamsplitter and said lens onto said reflective surface;

means for directing said light reflected from said reflective surface through said beamsplitter and onto said detector;

surface means for optically interrupting said light reflected from said surface, each of said interruptions corresponding to one bobbin assembly rotation.

11. Apparatus for detecting an improper stitch for a sewing machine, said machine including:

an axially reciprocal needle adapted to incorporate at least one needle thread into a succession of stitches, said needle moving along a longitudinal needle axis;

a drive motor having an output shaft and associated means for driving said needle through at least one reciprocal motion per stitch;

a rotatable bobbin assembly including means for incorporating a bobbin thread and said needle thread into said stitches during one stitch cycle; comprising:

means for detecting needle thread movement along said longitudinal needle axis during a predetermined portion of said stitch cycle;

means for detecting each of said output shaft rotations to identify said stitch cycle;

means for storing predetermined values corresponding to thread movement per said predetermined portion of said stitch cycle;

means for comparing said stored values with actual thread movement per predetermined portion of said stitch cycle; and means for identifying a stitch signal corresponding to instances wherein said stored values differ by a predetermined amount from said actual thread movement per predetermined portion of said stitch cycle, said stitch signal being indicative of formation of an improper stitch.

12. Apparatus for detecting motion of an elongated thread along its longitudinal axis comprising:

A. a detector housing having a channel extending therethrough along a channel axis for receiving said thread, whereby said longitudinal thread axis is substantially aligned with said channel axis;

B. beam generating means positioned on one side of said channel for generating an optical beam of predetermined width which intersects substantially the full width of said channel; and C. beam detection means positioned on the side of said channel opposite said beam generating means for detecting differences in thread characteristics along the length of said thread.

13. Apparatus according to claim 12 wherein said channel is of sufficient size to constrain movement of said needle thread within a predetermined region, said region being determined by boundaries of said beam.

14. Apparatus for detecting an improper stitch for a sewing machine, said machine including:

an axially reciprocal needle adapted to incorporate at least one needle thread into a succession of stitches, said needle movable along a longitudinal needle axis;

a drive motor having an output shaft and associated means for driving said needle through at least one reciprocal motion per stitch; the improvement comprising:

needle thread detection means for detecting needle thread movement along said longitudinal needle axis during a predetermined portion of said stitch cycle;

shaft rotation means for detecting each of said output shaft rotations;

signal means for generating a stitch signal corresponding to said predetermined portion of said stitch cycle wherein substantially no needle thread movement is detected, said stitch signal being indicative of formation of an improper stitch.

15. Apparatus according to claim 14 further comprising:

A. a detector housing having a channel extending therethrough along a channel axis for receiving said thread, whereby said longitudinal thread axis is substantially aligned with said channel axis;

B. beam generating means positioned on one side of said channel for generating an optical beam of predetermined width which intersects substantially the full width of said channel; and C. beam detection means positioned on the side of said channel opposite said beam generating means for detecting said optical beam, whereby movement of said thread through said optical beam is detected due to differences in thread surface characteristics along the length of said thread.

16. Apparatus according to claim 15 wherein said channel is of sufficient size to constrain movement of said needle thread within a predetermined region, said region being determined by boundaries of said beam.

* * * * *

UNITED STATES PATENT AND TRADEMARK OFFICE

CERTIFICATE OF CORRECTION

PATENT NO. : 5,140,920

DATED : August 25, 1992

INVENTOR(S) : Bellio et al.

It is certified that error appears in the above-identified patent and that said Letters Patent is hereby corrected as shown below:

On the title page, item (75) inventors: "Arauo" should read --Araujo--.

Signed and Sealed this

Seventh Day of September, 1993

Bruce Lehman

*Attest:*

BRUCE LEHMAN

*Attesting Officer*

*Commissioner of Patents and Trademarks*